United States Patent [19]

Ahmed

[11] Patent Number: 4,774,452

[45] Date of Patent: Sep. 27, 1988

[54] ZENER REFERENCED VOLTAGE CIRCUIT

[75] Inventor: Syed M. Ahmed, Borough of Flemington, N.J.

[73] Assignee: GE Company, Fairfield, Conn.

[21] Appl. No.: 55,545

[22] Filed: May 29, 1987

[51] Int. Cl.[4] ..... G05F 3/20

[52] U.S. Cl. ..... 323/314; 323/231

[58] Field of Search ..... 323/231, 313, 314, 316

[56] References Cited

U.S. PATENT DOCUMENTS

| | | | |
|---|---|---|---|
| 3,310,731 | 3/1967 | Ostroff et al. | 323/313 |
| 3,916,508 | 11/1975 | Conzelman et al. | 323/231 X |
| 4,290,005 | 9/1981 | Arumugham | 323/313 |
| 4,352,056 | 9/1982 | Cave et al. | 323/314 |
| 4,560,919 | 12/1985 | Ishikawa et al. | 323/314 |
| 4,609,863 | 9/1986 | Asai et al. | 323/231 X |

*Primary Examiner*—Patrick R. Salce
*Assistant Examiner*—Marc S. Hoff
*Attorney, Agent, or Firm*—S. C. Corwin; H. I. Schanzer; B. E. Morris

[57] ABSTRACT

A zener diode is connected at one end via a first impedance to a first power terminal. The base-to-emitter junctions of first and second transistors are connected in parallel between the other end of the zener diode and a second power terminal. The collector of the first transistor is connected to the one end of the zener diode to regulate the zener current and hence the zener voltage. A third transistor is coupled at its base to the one end of the zener and its emitter is connected to an output terminal to produce an output voltage which is a function of the zener voltage. The collector of the second transistor is connected to the emitter of the third transistor to pass a current through the third transistor which is approximately equal to the current through the first and second transistors whereby the base-to emitter junction of the third transistor and its temperature variations have little, if any, effect on the output voltage.

9 Claims, 2 Drawing Sheets

10

VCC
15
R10
19
R11
21
IA
Z1
IC1
Q1
17
25
D1
R1
IR1
VREF
R2
D2
D3
29
R3
D4
27
40
Q4
35
Q6
D10
R12
R13
R7
31
Q5
42
Q7
R8
34
33
R9
Q3
23
Q2
VO

100 FIG. 2
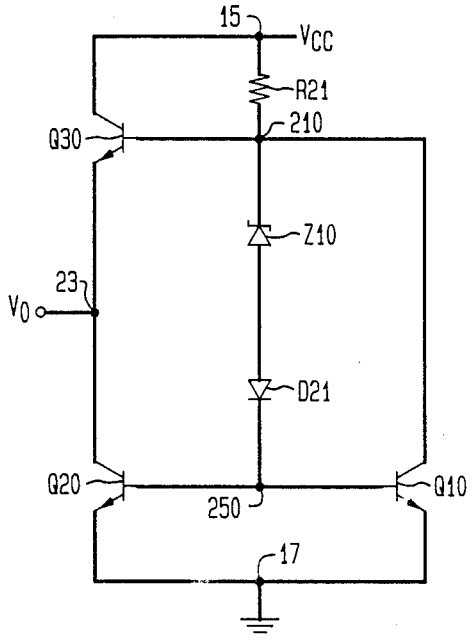

ZENER REFERENCED VOLTAGE CIRCUIT

FIELD OF THE INVENTION

This invention relates to a reference voltage sources and, in particular, to reference voltage circuits which use a zener diode.

BACKGROUND OF THE INVENTION

The use of the reverse breakdown characteristic of a zener diode as a reference voltage is known in the art. Normally, the zener diode is connected in series with an impedance across a source of operating potential with the zener voltage serving as a source of reference voltage. Ideally, the zener voltage should be absolutely constant as a function of temperature variations and changes in the operating voltage. However, due to the finite ynamic resistance of the zener diode, the zener voltage ($V_Z$) produced by a zener diode changes (e.g., increases) when the current through the zener diode changes (e.g. increases) due to a change (e.g. increase) in the operating voltage. Furthermore, a zener diode typically has a (positive or negative) temperature coefficient, whereby its zener voltage varies as a function of temperature. An additional problem is that a zener diode having a desirable temperature coefficient may not have the exact value of the voltage desired. For example, a zener diode having desirable characteristics and a low positive temperature coefficient is a P+N+ diode whose zener voltage is approximate 5.6 volts. However, in many applications, it is desirable and/or necessary to have a reference voltage other than 5.6 volts. It is therefore necessary to process and alter the zener voltage to produce the desired reference voltage. It is further necessary that the desired reference voltage so produced be relatively constant over a wide range of temperature and operating voltage and variations related to semiconductor process changes.

SUMMARY OF THE INVENTION

Circuits embodying the invention include a zener diode connected at one end via an impedance means to a first power terminal and connected at its other end via the base-to-emitter region of a first transistor to a second power terminal. The collector of the first transistor is returned to the one end of the zener diode to provide current regulation for the zener diode. The base-to-emitter region of a second transistor is also connected between the other end of the zener diode and the second power terminal whereby the second transistor "mirrors" the current flowing through the first transistor. A third transistor is coupled at its base to the one end of the zener diode and at its emitter to an output terminal for producing, at the output terminal, an output source voltage ($V_O$) which is a function of the zener voltage. The collector of the second transistor is coupled to the emitter of the third transistor for controlling the current through the third transistor whereby the base-to-emitter voltage ($V_{BE}$) of the third transistor varies in similar fashion to that of the first and second transistors. Consequently, the base-to-emitter voltage of the third transistor and its temperature variations have little effect on the output source voltage ($V_O$) produced at the output terminal.

Circuits embodying the invention may also include means for applying the zener voltage across a reference network which includes a reference point at which is produced an intermediate reference voltage ($V_{REF}$) which has a very low temperature coefficient and which is therefore relatively constant with temperature. The intermediate reference voltage ($V_{REF}$) is applied to a comparator circuit for producing at one output of the comparator circuit a predetermined voltage having a value other than the zener voltage. The reference network and the comparator circuit are directly connected across the zener diode whereby the variations in the base-to-emitter voltages of the first and second transistors have little, if any, effect on the operating potential applied across the reference network and the comparator circuit.

BRIEF DESCRIPTION OF THE DRAWINGS

In the accompanying drawing like reference characteristics denote like components; FIG. 2 is a schematic diagram of another regulated voltage circuit in accordance with another embodiment of the present invention.

DETAILED DESCRIPTION OF THE INVENTION

Figure 1:
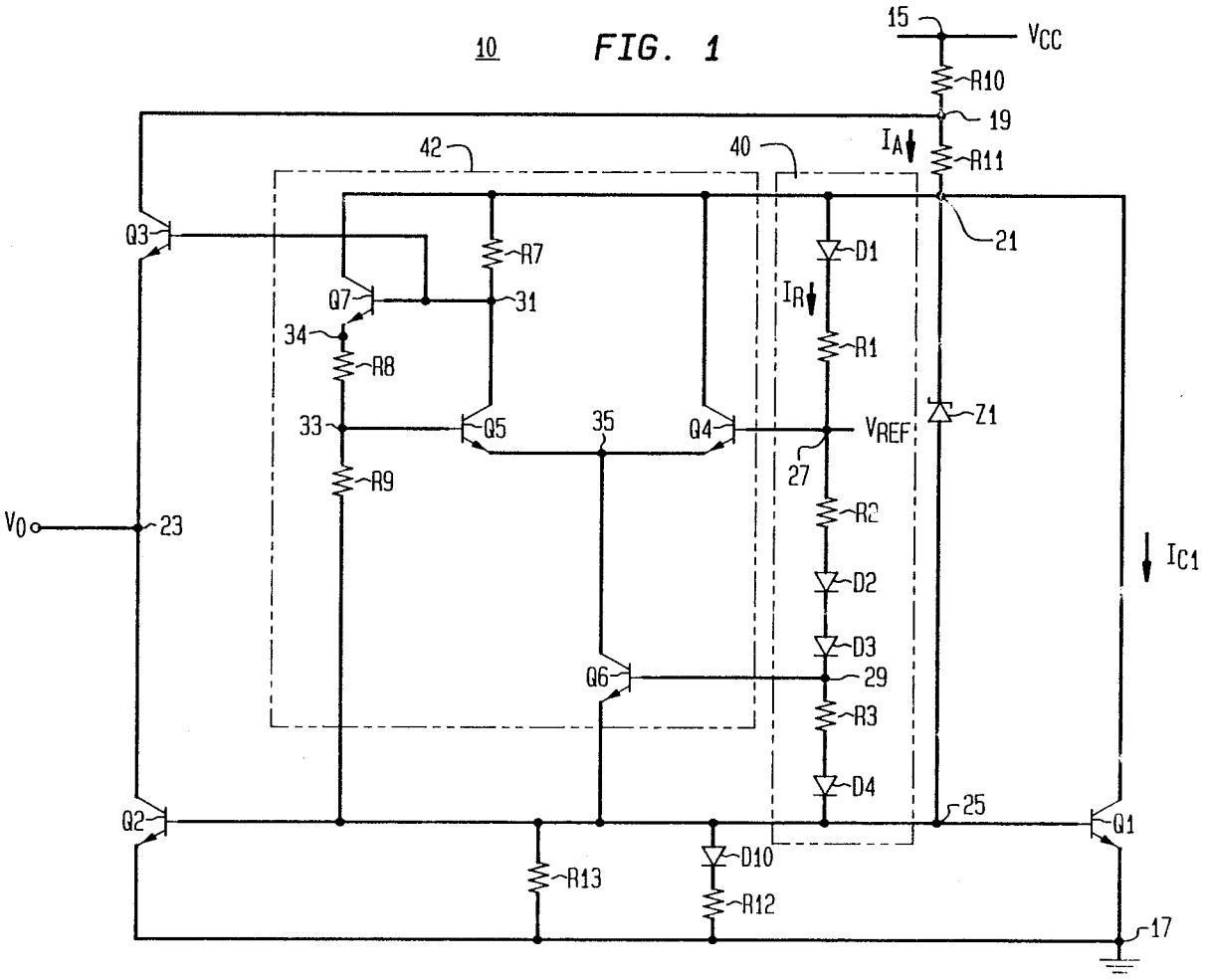
FIG. 1 is a schematic diagram of a regulated voltage circuit in accordance with one embodiment of the present invention.

Referring now to FIG. 1, there is shown a regulated voltage circuit 10 in accordance with the present invention. Circuit 10 functions to produce at an output terminal 23 thereof an output voltage $V_O$ which is essentially constant independent of temperature variations and independent of relatively large changes in a supply voltage $V_{CC}$ which powers circuit 10 and is coupled between first 15 and second 17 power terminals thereof. In one typical embodiment $V_{CC}$ is positive and terminal 17 is held at ground potential.

Circuit 10 comprises zener diode Z1, NPN bipolar transistors Q1, Q2, Q3, Q4, Q5, Q6 and Q7, diodes D1, D2, D3, D4 and D1O and resistors R1, R2, R3, R8, Rg, R10, R11, R12 and R13. Diodes D1, D2, D3 and D4 and resistors R1, R2 and R3 are shown within a dashed line rectangle which is denoted as reference network 40 and will also be denoted as a diode-resistor string. Transistors Q4, Q5, Q6 and Q7 and resistors R7, R8 and R9 are shown within another dashed line rectangle which is denoted as comparator circuit 2.

A first terminal of R10 is coupled to terminal 15 and a second terminal of R10 is coupled to a first terminal of R11, to the collector of Q3 and to a node 19. The emitters of Q1 and Q2 and second terminals of R12 and R13 are connected to terminal 17. A second terminal of R11 is coupled to the cathode of Z1, to the anode of D1, to the collectors of Q1, Q4 and Q7, to a first terminal of R7 and to a node 21. The cathode of Z1 is coupled to the bases of Q1 and Q2, to the anode of D10, to the cathode of D4, to first terminals of R13 and R9 and to a node 25. The cathode of D1 is coupled to a first terminal of R1. A second terminal of R1 is coupled to the base of Q4, to a first terminal of R2 and to a node 27 ($V_{REF}$). A second terminal of R2 is coupled to the anode of D2. The cathode of D2 is coupled to the anode of D3. The anode of D3 is coupled to the base of Q6, to a first terminal of R3 and to a node 29. A second terminal of R3 is coupled to the anode of D4.

The emitters of Q4 and Q5 are coupled together to the collector of Q6 and to a node 35. A second terminal of R7 is coupled to the collector of Q5, to the bases of Q3 and Q7, and to a node 31. The emitter of Q7 is coupled to a first terminal of R8 and to a node 34. A second terminal of R8 is coupled to a second terminal of R9, to the base of Q5 and to a node 33. The emitter of Q3 is coupled to the collector of Q2 and to output terminal 23.

For reasons detailed below, Q2 is designed to have the same geometry and characteristics as Q1. As a result, the base-to-emitter voltage ($V_{BE2}$) of Q2 is the same as the base-to-emitter voltage ($V_{BE1}$) of Q1 and, normally, equal currents will flow from node 25 into the bases of Q1 and Q2. Transistor Q2 will then conduct and "mirror" a collector current ($I_{C2}$) equal to the collector current ($I_{C1}$) flowing in Q1. Q1 and Q2 serve to regulate the current flowing through Z1 and hence the voltage applied across Z1.

The combination of R12, R13 and D10 serve as a current bleeder network to bleed off some of the current flowing into the bases of Q1 and Q2. D10 also provides temperature compensation for Q1 and Q2.

A zener voltage ($V_Z$) generated between nodes 21 and 25, also denoted as a voltage $v_{12}$, is applied to reference network 40. The diodes of 40 have a negative temperature coefficient (e.g., −2 millivolts/°C.), while the resistors have a positive temperature coefficient (e.g., +0.38%/°C.) for ion implanted N-type resistors. By appropriate choice of the number of diodes and the number and value of the resistors, there is a point (i.e., node 27) along the diode-resistor string at which an intermediate reference voltage ($V_{REF}$) is produced which changes very little over a very wide temperature range. D1 through D4 may be PN junctions or they may be transistors with their bases connected to their collectors, or they may be other suitable types of diodes.

Comparator circuit 40 generates at an output node 31 thereof a voltage derived from the voltage at node 21 having a predetermined value other than $V_{21}$. The voltage ($V_{31}$) at node 31 is then used to produce the desired value of the source voltage ($V_O$) at output terminal 23. Nodes 27 ($V_{REF}$) and 33 serve as the two inputs to comparator circuit 40. Q4 and Q5 are a differential pair with Q6 being a current source for Q4 and Q5. Connecting the base of Q6 to a point (node 29) along the resistor-diode string, provides bias for Q6 and also ensures that changes (e.g., an increase) in the current through the diode-resistor string, due to changes (e.g., an increase) in the zener voltage, cause a corresponding change (e.g., an increase) in the collector current of Q6 which will be reflected in the collector currents of Q4 and Q5 and which will tend to maintain the voltage ($V_{31}$) at output node 31 of the comparator at, or close to, the predetermined value desired at node 31.

The ratio of R8 to R9 determines the portion of the voltage present at nodes 31 and 34 which is applied to node 33 and the base of Q5. Consequently, the voltage at node 31 will be greater than the voltage at nodes 27 and 33.

Transistor Q3 which functions, in part, as an output emitter follower is connected at its base to node 31, at its collector to node 19 and at its emitter to output terminal 23.

As already noted, reference network 40 include diodes having a negative temperature coefficient (i.e., −2 mV/°C.) and resistors having a positive temperature coefficient. It may therefore be deduced that by appropriate choice of resistor values and by appropriate choice of the number of diodes and their placement, a reference point (i.e., node 27) is produced along the diode-resistor string whose voltage changes very little with temperature. In fact, the current ($I_R$) through the diode-resistor string may be obtained by noting that:

$$V_Z = I_R(R_1+R_2+R_3)+NV_{BE} \qquad \text{EQ.A}$$

when N is equal to the total number of diodes in the string.

The current $I_R$ may then be expressed as follows:

$$I_R = (V_Z - NV_{BE}/R_1+R_2+R_3 \qquad \text{EQ.B}$$

By assigning ohmic values to $R_1$, $R_2$ and $R_3$ the value of $I_R$ is set. In addition, to ascertain the conditions for which $I_R$ will not change with temperature, the current $I_R$ in equation B may be differentiated with respect to temperature and made equal to zero. The result of the differentiation indicates certain conditions to be met to generate an intermediate voltage reference point having a very low temperature coefficient. By way of example, in a particular circuit embodying the invention in which $I_R$ was selected to have a value of approximately 100 microamperes, R1 was made equal to 20,600 ohms, R2 was made equal to 8,200 ohms, R3 was made equal to 125 ohms, a diode D1 was connected in series with R1 between nodes 21 and 27, two diodes D2 and D3 were connected in series with R2 between nodes 27 and 29, and a diode D4 was connected in series with R3 between nodes 29 and 25. For the resistor values noted above with $V_Z$ equal to 5.6 volts, a voltage $V_{REF}$ was produced at node 27 which was equal to 2.988 volts, at room temperature. The intermediate reference voltage $V_{REF}$ was found to vary by 6 parts per million per degree centigrade (6 PPM/°C.) over a temperature range extending from 0° C. to 125° C.

Various features of the invention may best be appreciated by examining certain aspects of the operation of the circuit of FIG. 1 in greater detail.

In the description of the operation to follow assume that $V_{CC}$ applied to terminal 15 is greater than [$V_Z+V_{BE1}$] volts with respect to ground; where $V_Z$ is the zener voltage of diode $Z_1$ and $V_{BE1}$ is the base-to-emitter voltage of either transistor Q1 or transistor Q2. [The $V_{BE}$ of a transistor may nominally be assumed to be equal to 0.7 volts, but $V_{BE}$, as is well known, varies as a function of the current level through the transistor and temperature.]For values of $V_{CC}$ greater than [$V_Z+V_{BE1}$] volts, zener diode $Z_1$ breaks down and conducts in the reverse direction. A current then flows via resistors R10 and R11 into node 21 and via diode $Z_1$, which conducts in the reverse direction, into node 25. The current flowing into node 25 flows to ground via the bases of transistors Q1 and Q2 and the two paths provided by the bleeder network. However, it is the base-to-emitter regions of transistors Q1 and Q2, connected in parallel between node 25 and terminal 17, which primarily establish a voltage of $V_{BE1}$ volts at node 25 when $V_{CC}$ exceed [$V_z+V_{BE1}$] volts.

For $V_{CC}$ greater than $V_Z+V_{BE1}$, the voltage ($V_{21}$) at node 21 may be expressed as follows:

$$V_{21} = V_Z + V_{BE1} \qquad \text{EQ.1}$$

By way of example, for $V_Z$ equal to 5.6 volts and $V_{BE1}$ equal to 0.7 volts, $V_{21}$ equals 6.3 volts.

The zener voltage ($V_Z$) is held relatively constant over a wide range of operating voltages due to extensive regulation of the zener current, as demonstrated below. It is evident from an examination of the circuit that, with $V_{21}$ held at $[V_Z+V_{BE1}]$ volts, the current ($I_A$) through resistor R10 increases as $V_{CC}$ increases above $[V_Z+V_{BE1}]$ volts. For $V_Z$ equal to 5.6 volts a change in $V_{CC}$ from 10 volts to 18 volts causes $I_A$ to change by nearly a factor of three going from a value of less than 1 milliampere to a value somewhat less than 3 milliamperes, for R10 and R11 being equal to 1.5 K ohms and 2.7 K ohms, respectively.

It is also evident from the circuit that, as the current $I_A$ into node 21 increases, the zener current ($I_Z$) through zener diode Z1 increases and more current flows into node 25. [An increase in the current flow through Z1 tends to increase the zener voltage and hence to cause a reduction in the current increase, but this is a second order effect and may be neglected.] Most of the increased zener current through Z1 flows into the bases of transistors Q1 and Q2. [The additional base and collector current into Q1 and Q2 causes a slight increase in their $V_{BE}$ and hence a slight increase in the voltage at node 25 causing a slight increase in the bleeder current, but this is also a second order effect and may be neglected in this discussion.] The increased base drive to Q1 causes an increase in its collector current, $I_{C1}$. The increased $I_{C1}$ current in Q1 is drawn out of node 21 reducing the increase in the zener current into node 21 flowing through diode Z1. In an analogous manner for a decrease in $I_Z$ due to decreasing $V_{CC}$, $I_{C1}$ decreases causing a reduction in the decrease of $I_z$. Thus, Q1 functions to regulate the zener current as a function of increasing or decreasing changes in the operating voltage $V_{CC}$, and by regulating the zener current, the zener voltage is maintained at a relatively constant value.

Another loop which also functions to regulate the zener current and hence the zener voltage includes transistors Q2 and Q3. When the current through Z1 increases, part of the increased current into node 25 flows into the base of Q2. This causes an increase in the collector current ($I_{C2}$) of Q2 which in turn causes an increase in the emitter current of Q3. The increased emitter current of Q3 causes a corresponding increase in the collector current of ($I_{C3}$) of Q3. The increased $I_{C3}$ current flows from $V_{CC}$ via R10 and out of node 19 into the collector of Q3. The increase in $I_{C3}$ causes a drop in the voltage at node 19 and also at node 21 inhibiting a change in the voltage at node 21 of a change in the zener current. Clearly, mirroring part of the zener current through Q2 and drawing the collector current of Q2 from the emitter of Q3 whose collector current is then drawn from $V_{CC}$ via R10 provides current and voltage regulation to the zener diode in addition to that provided by Q1. Hence, the current through the zener diode and the resultant zener voltage is regulated by means of one loop comprising resistors R10 and R11 and transistor Q1 and another loop comprising resistor R10 and transistors Q2 and Q3.

A significant feature of the circuit of FIG. 1 is the multiple role played by output transistor Q3. The role of Q3 in regulating the zener current by connecting the collector of Q3 to node 19, has already been discussed. Another role of Q3 may be explained by first noting that the voltage applied to the base of Q3 is equal to the voltage ($V_{31}$) developed at node 31 and that (neglecting the effect of base currents) $V_{31}$ may be expressed as follows:

$$V_{31}=V_{21}-I_{C5}R_7=V_Z-I_{C5}R_7+V_{BE1} \qquad \text{EQ. 2}$$

where:

(a) $V_{21}$ is equal to $[V_Z+V_{BE1}]$; with $V_{BE1}$ being equal to the $V_{BE}$ of Q1 or Q2;

(b) $I_{C5}$ is the collector current of Q5; and (c) $R_7$ is the ohmic value of resistor R7.

Since $V_{31}$ is the voltage applied to the base of Q3, the output voltage ($V_O$) produced at the emitter of Q3 may be expressed as follows:

$$V_O=V_{31}-V_{BE3} \qquad \text{EQ. 3}$$

where $V_{BE3}$ is the $V_{BE}$ of Q3

Substituting the values of $V_{31}$ from above, equation 3 may be rewritten as follows:

$$V_O=V_Z-I_{C5}R_7+V_{BE1}-V_{BE3}; \qquad \text{EQ. 4}$$

Recall that the base-to-emitter regions of transistors Q1 and Q2 are connected in parallel and that, where Q1 and Q2 are made to have like geometries, their characteristics will be very similar and they will respond in a very similar manner. Thus, for the above assumption, the collector current ($I_{C1}$) flowing through Q1 is essentially the same as the current $I_{C2}$ flowing through the collector of Q2. The collector current $I_{C2}$ is equal to the emitter current of transistor Q3 (neglecting the load current). Hence, to a first approximation and neglecting base currents, the current flowing through Q3 is approximately equal to the current flowing through Q1 and Q2. For this condition, and assuming the geometry of Q3 to be similar to that of Q1 and Q2, the $V_{BE}$ of transistor Q1 (or Q2) is approximately equal to the $V_{BE}$ of transistor Q3. Since $V_{BE1}$ is approximately equal to $V_{BE3}$, equation 4 for $V_O$ reduces to the following:

$$V_O=V_Z-I_{C5}R_7 \qquad \text{EQ. 5}$$

$V_O$ is independent of $V_{BE}$ and $V_{BE}$ variations since equation 5 does not include any $V_{BE}$ terms. Equation 5 reflects that by controlling the emitter current out of Q3 with "current mirror" Q2, the $V_{BE}$ of Q3 and its temperature variations are subtracted and have little, if any effect on $V_O$. That is, the $V_{BE}$ of Q1 (or Q2) superimposed on $V_Z$ at node 21 and applied to the base of Q3 (less a voltage drop across R7) is subsequently subtracted out as the voltage produced at the emitter of Q3.

It has been shown that in circuits embodying the invention the zener voltage is relatively regulated. It has also been shown that in circuits embodying the invention the zener diode is coupled to a point of operating potential (e.g. ground) via the base-to-emitter junction of one or more transistors used to regulate the current through the zener. It has also been shown that the effect of the base-to-emitter (e.g. $V_{BE1}$) of the current regulating transistor, which is superimposed on the zener voltage, is subsequently subtracted from the output voltage, whereby the output voltage is a function of the zener voltage and is virtually independent of $V_{BE}$ and its variations.

For the conditions set forth in equations 1 through 5 and as discussed above, the functions of the comparator circuit is to modify the voltage at node 21 to produce a predetermined voltage at node 31. For example, to set the output $V_O$ equal to 5 volts with $V_Z$ equal to 5.6 volts, the voltage drop across R7 should be equal to 0.6 volt. The voltage $V_{31}$ would then be equal to $[V_z-0.6+V_{BE1}]$ volts. With $V_Z$ equal to 5.6 volts $V_{31}$ would equal 5.0 volts $+V_{BE1}$.

The conditions of the comparator to produce the desired voltage at node 31 are now examined.

As already noted the comparator has two input nodes (e.g. nodes 27 and 33) and an output node 31. The intermediate or internal reference voltage ($V_{REF}$) is applied to node 27. $V_{REF}$ is obtained by first generating a well regulated zener voltage and then applying the regulated zener voltage across a reference network having a low temperature coefficient point.

The combination of the regulated voltage and the reference network results in an internal reference voltage ($V_{REF}$) having a stable value with a very low temperature coefficient over a wide range of temperature and operating voltage changes. A voltage derived from comparator output node 21 is applied to the other input (node 33) of the comparator. The voltage at node 31 is applied via the base-to-emitter of Q7 and the voltage divider network comprised of resistors R8 and R9, to the base of Q5.

$V_{31}$ minus the $V_{BE}$ of Q7 is equal to the voltage at $V_{34}$. $V_{34}$ minus a $V_{BE1}$ drop divided by the ohmic value of R8 and R9 yields the current ($I_D$) in the divider network. The voltage drop across R9 plus the $V_{BE1}$ drop represents the voltage applied to the base of Q5. The collector current $I_{C5}$ through Q5 then sets up the desired drop across resistor R7. The value of $I_{C5}$ to produce a desired voltage drop (e.g., 0.6 volt) may be calculated given a value of R7 since $I_{C5}$ must equal 0.6 volt divided by the ohmic value of R7.

Note that Q7, R8 and R9 provide negative feedback tending to stabilize the value of $V_{31}$. For eample if the voltage $V_{31}$ starts to go positive, a higher voltage is applied to the base of Q5 tending to increase the current in Q5 and to decrease the voltage use at node 31. Vice-versa, when $V_{31}$ decreases $V_{33}$ goes lower, causing the collector current of Q5 to decrease $V_{31}$ and to go positive. Hence the voltage at node 31 is controlled by the value of $V_{REF}$, the network divider ratio and the currents through Q4 and Q5. The quiescent currents in Q4 and Q5 are controlled by Q6 since the sum of the emitter currents of Q4 and Q5 is equal to the collector current of Q6 whose value is controlled by the voltage and current present at bias node 29. In addition, note that if $V_Z$ increases, a greater voltage is applied to the base of Q6. This causes the collector current of Q6 to increase which in turn causes an increase in the collector currents $I_{C5}$ and $I_{C4}$ of Q5 and Q4, respectively. Since the voltage $V_{31}$ is equal to $V_Z - I_{C5}R_7$, if an increase in $V_Z$ causes a corresponding increase in $I_{C5}$ the voltage at node 31 will exhibit a high degree of regulation and stability.

A significant aspect of the invention is that reference network 40 and the comparator circuit are "powered" by the potential developed between node 21 and node 25. Not that the potential of $V_{BE1}$ volts present at node 25 functions as the "ground" for the reference network 40 and the comparator circuit. Note also that the potential of $[V_Z + V_{BE1}]$ volts present at node 21 functions as the "high" voltage for the reference and comparator circuits. The variations in $V_{BE1}$, however caused (e.g. temperature, voltage, noise), will appear at nodes 25 and 21. Hence they will tend to cancel out and not affect the operation of the circuits. It is therefore significant that the emitter of Q6, the one end of R9 and the cathode of diode D4 are returned to node 25 rather than directly to ground potential.

Thus, in the circuits embodying the invention, perturbations due to temperature and operating voltage variations are significantly reduced.

An illustrative embodiment has the following parameters:

$V_{CC} = +10$ to $+18$ volts with ambient temperature ranges from 0° C. to 125° C.

R1=20,600 ohms, R2=8,200 ohms, R3=125 ohms R8=15,000 ohms, R9=30,000 ohms

Z1 is a zener diode having a zener voltage (reverse breakdown voltage) of 5.6 volts and a temperature coefficient of +2 millivolts per degree centigrade (+2 mV/°C.)

$V_{REF}$=2.988 volts at 20° C.

$I_R$=100 microamperes $V_O$=5.00 volts

In the circuit of FIG. 1, the zener voltage is modified to produce an output $V_o$ having a value other than $V_Z$. Where $V_Z$ is to be produced at the output of the circuit and where as high a degree of regulation is not needed, the circuit of FIG. 1 may be simplified as shown in FIG. 2.

Referring now to FIG. 2, there is shown another regulated voltage circuit 100 in accordance with the present invention. Circuit 100, which provides the same basic function as circuit 10 of FIG. 1, but may have some what poorer regulation, comprises NPN bipolar transistors Q10, Q20, and Q30, a zener diode Z10, a PN diode D21 and a resistor R21. R21, which functions as a voltage dropping impedance, is connected between terminal 15 and node 210. Zener diode Z10 is connected in series with a diode D21 between nodes 210 and 250. Diode D21 is connected in series with Z10 to provide temperature compensation for the zener diode. Q10 functions to regulate the zener current and voltage as discussed above in FIG. 1. Q20 mirrors the current in Q10 and draws its collector current from the emitter of Q30 connected to output terminal 23. Q30, whose collector is connected to terminal 15, functions solely as an emitter follower. However, the collector of Q30 could be returned to a point along R21 between node 210 and terminal 15 to provide regulation, as in FIG. 1. Q30 couples the voltage at $V_{21}$ minus its emitter-to-base voltage to output terminal 23. Assuming the geometries of Q10, Q20, and Q30 to be very nearly equal, the voltage ($V_{21}$) at node 21 will, as in FIG. 1, be equal to:

$$V_{210} = V_Z + V_{D21} + V_{BE10};$$

The voltage ($V_o$) at output terminal 23 will then be $$V_o = V_Z + V_{D21} + V_{BE10} - V_{BE30};$$

For the assumption of Q10, Q20 and Q30 having similar geometries, collector current of Q20 is nearly equal to that of Q10 and that of Q30. $V_{BE10}$ is then approximately equal to $V_{BE30}$ and Vo is then equal to $V_Z + V_{D21}$. The voltage produced at node 23 can then drive many suitable loads.

It is to be understood that the embodiments described herein are merely illustrative of the general principle of the invention. Various modifications are possible within the scope of the invention. For example, PNP transistors could be substituted for the NPN transistors provided the power supplies are appropiately modified.

What is claimed is:

1. Apparatus comprising:

first and second power terminals for the application therebetween of an operating potential;

first and second intermediate nodes;

an impedance means connected between said first power terminal and said first intermediate node;

a zener diode for producing a zener voltage ($V_Z$) connected between said first and second intermediate nodes;

an output terminal for producing thereat a voltage which is a function of the zener voltage across said zener diode;

first, second and third bipolar transistors, each transistor having an emitter and a collector defining the ends of a main conduction path and a base for controlling the conductivity of the conduction path;

means connecting the bases of said first and second transistors to said second intermediate node and their emitters to said second power terminal;

means connecting the collector of said first transistor to said first intermediate node;

means connecting the collector of said second transistor to said output terminal;

means direct current connecting the emitter of said third transistor to said output terminal;

means coupling the base of said third transistor to said first intermediate node;

means coupling the collector of said third transistor to a point of potential;

a reference network comprised of a series string of resistors and diodes connected between said first and second intermediate nodes, said reference network having a reference point at which a reference voltage is produced which varies very little with respect to temperature;

a comparator circuit coupled between said first and second intermediate nodes for applying said zener voltage to said comparator; and said comparator circuit having an output node and being responsive to said reference voltage for producing a predetermined output voltage at said output node and for applying said predetermined output voltage to the base of said third transistor.

2. The apparatus of claim 1 wherein:

said comparator circuit has first and second signal inputs;

said first signal input being coupled to said reference point;

said comparator circuit further comprising a resistive divider network coupled between said output node and said second intermediate node for producing a educed voltage which is a function of, and is proportional to, the voltage at said output node and for applying said reduced voltage to the second signal input of said comparator.

3. The apparatus of claim 2 wherein said comparator circuit comprises:

a first comprator transistor coupled at its base, collector and emitter to said reference point, to said first intermediate node and to a common point, respectively;

a second comparator transistor coupled at its collector, base and emitter to said output node, to said second signal input and to said common point, respectively; and an impedance means coupled between said first intermediate node and said comparator output node.

4. The apparatus of claim 3 further comprising a third comparator transistor coupled at its collector, emitter and bae to said common point, to said second intermediate node and to a bias point along said series string of resistor and diodes, respectively.

5. Apparatus comprising:

first and second power terminals for the application therebetween of an operating potential;

first and second intermediate nodes;

first and second resistors;

said first resistor being coupled between said first power terminal and a first junction;

said second resistor being coupled between said first junction and said first intermediate node;

a zener diode for producing a zener voltage ($V_Z$) connected between said first and second intermediate nodes;

an output terminal for producing thereat a voltage which is a function of the zener voltage across said zener diode;

first, second and third bipolar transistors, each transistor having an emitter and a collector defining the ends of a main conduction path and a base for controlling the conductivity of the conduction path;

means connecting the bases of said first and second transistors to said second intermediate node and their emitters to said second power terminal;

means connecting the collector of said first transistor to said first intermediate node;

means connecting the collector of said second transistor to said output terminal;

means direct current connecting the emitter of said third transistor to said output terminal;

means coupling the base of said third transistor to said first intermediate node; and means coupling the collector of said third transistor to said first junction.

6. The apparatus of claim 5 wherein said first and second transistor have similar geometries and their corresponding base-to-emitter voltages are approximately equal when like currents flow through both, whereby the collector current passing through said first transistor is essentially equal to the collector current passing through said second transistor.

7. The apparatus of claim 6 wherein said third transistor has a geometry similar to that of the geometries of the first and second transistors.

8. Apparatus comprising:

first and second power terminals for the application therebetween of an operating potential, first and second intermediate nodes;

a first impedance means connected between said first power terminal and a first junction;

a second impedance means connected between said first junction and said first intermediate node;

a zener diode for producing a zener voltage;

means coupling said zener diode between said first and second intermediate nodes;

an output terminal for producing thereat a voltage which is a function of the zener diode;

first, second and third bipolar transistors, each transistor having an emitter and a collector defining the ends of a main conduction path and a base for controlling the conductivity of the conduction path;

means connecting the bases of said first and second transistors to said second intermediate node and their emitters to said second power terminal;

means connecting the collector of said first transistor to said first intermediate node;

means connecting the collector of said second transistor to said output terminal;

means direct current connecting the emitter of said third transistor to said output terminal;

means coupling the base of said third transistor to said first intermediate node; and means coupling the collector of said third transistor to said first junction.

9. Apparatus comprising:

first and second power terminals for the application therebetween of an operating potential;

first and second intermediate nodes;

a first impedance means connected between said first power terminal and a first junction;

a second impedance means connected between said first junction and said first intermediate node;

a zener diode for producing a zener voltage;

means coupling said zener diode between said first and second intermediate nodes;

an output terminal for producing thereat a voltage which is a function of the zener diode;

first, second and third bipolar transistors, each transistor having an emitter and a collector defining the ends of a main conduction path and a base for controlling the conductivity of the conduction path;

means coupling the bases of said first and second transistors to said second intermediate node and their emitters to said second power terminal;

means coupling the collector of said first transistor to said first intermediate node for passing a current via the collector of said first transistor which is proportional to the base current into the base of said first transistor;

means coupling the collector of said second transistor to said output terminal for passing a current via the collector of said second transistor which is proportional to the current into the base of said second transistor;

means coupling the base-to-emitter region of said third transistor between said first intermediate node and said output terminal for producing an output voltage which is a function of the zener voltage; and means coupling the collector of said third transistor to said first junction.

* * * * *